US010689136B2

(12) United States Patent
Ehrmann

(10) Patent No.: US 10,689,136 B2
(45) Date of Patent: Jun. 23, 2020

(54) THERMO-FORMING PACKAGING MACHINE

(71) Applicant: MULTIVAC Sepp Haggenmüller SE & Co. KG, Wolfertschwenden (DE)

(72) Inventor: Elmar Ehrmann, Bad Grönenbach (DE)

(73) Assignee: Multivac Sepp Haggenmüller SE & Co. KG, Wolfertschwenden (DE)

( * ) Notice: Subject to any disclaimer, the term of this patent is extended or adjusted under 35 U.S.C. 154(b) by 243 days.

(21) Appl. No.: 15/795,120

(22) Filed: Oct. 26, 2017

(65) Prior Publication Data

US 2018/0118383 A1 May 3, 2018

(30) Foreign Application Priority Data

Oct. 28, 2016 (EP) ..... 16196154

(51) Int. Cl.

| | |
|---|---|
| ***B65B 7/16*** | (2006.01) |
| ***B65B 9/04*** | (2006.01) |
| ***B65B 35/24*** | (2006.01) |
| ***B65B 41/12*** | (2006.01) |
| ***B65B 65/00*** | (2006.01) |
| ***B65B 61/06*** | (2006.01) |
| ***B65B 61/28*** | (2006.01) |

(52) U.S. Cl.

CPC ..... *B65B 7/164* (2013.01); *B65B 9/04* (2013.01); *B65B 9/045* (2013.01); *B65B 35/24* (2013.01); *B65B 41/12* (2013.01); *B65B 61/06* (2013.01); *B65B 61/28* (2013.01); *B65B 65/003* (2013.01)

(58) Field of Classification Search

CPC ..... B65B 7/164; B65B 9/04; B65B 9/045; B65B 35/24; B65B 41/12; B65B 61/06; B65B 61/28; B65B 65/003

USPC ..... 53/559, 561, 329.2, 329.3, 329.5

See application file for complete search history.

(56) References Cited

U.S. PATENT DOCUMENTS 3,303,628 A * 2/1967 Lovas et al. ..... B65B 9/04 53/433

3,766,702 A * 10/1973 Meissner et al. ..... B65B 9/042 53/453

(Continued)

FOREIGN PATENT DOCUMENTS

CA 2498654 A1 * 4/2004 ..... B65B 9/04

CN 1146755 A 4/1997

(Continued)

*Primary Examiner* — Stephen F. Gerrity

(74) *Attorney, Agent, or Firm* — Husch Blackwell LLP

(57) ABSTRACT

A thermo-forming packaging machine having a transport device that is configured to convey a lower film in a film transport surface along a transport direction from a forming station for forming troughs in the lower film via an inserting track for filling the troughs with products to a sealing station for sealing the troughs with an upper film and further to a cutting station for separating the sealed troughs. The film transport surface may include an area that ascends along the transport direction, either between the forming station and the sealing station or following the sealing station. The ascending areas may be followed in the transport direction by an even area. As a result, one of a product feeding device for feeding of products or a packaging discharge device for leading away packages may be positioned particularly close to the lower film.

19 Claims, 2 Drawing Sheets

(56) References Cited

U.S. PATENT DOCUMENTS

| | | | | | |
|---|---|---|---|---|---|
| 4,034,536 | A * | 7/1977 | Mahaffy et al. | B65B 9/04 | 53/433 |
| 4,366,663 | A * | 1/1983 | Grebe | B65B 31/021 | 425/121 |
| 4,571,924 | A * | 2/1986 | Bahrani | B65B 9/042 | 53/453 |
| 5,081,816 | A * | 1/1992 | Cardinali | B65B 5/06 | 53/157 |
| 5,155,981 | A * | 10/1992 | Tordini | B65B 35/18 | 198/468.4 |
| 6,701,695 | B1 | 3/2004 | Douglas | | |
| 7,392,631 | B2 * | 7/2008 | Conti | B65B 9/045 | 226/30 |
| 8,820,037 | B2 * | 9/2014 | Ehrmann | B65B 35/24 | 53/251 |
| 2013/0319818 | A1 * | 12/2013 | Worz | B65B 35/24 | 198/426 |
| 2014/0260123 | A1 * | 9/2014 | Drechsler et al. | B65B 35/24 | 53/559 |
| 2015/0203226 | A1 * | 7/2015 | Baroncini | B65B 9/045 | 221/1 |

FOREIGN PATENT DOCUMENTS

| | | | | | |
|---|---|---|---|---|---|
| CN | 104703881 | A | 6/2015 | | |
| CN | 104787371 | A | 7/2015 | | |
| CN | 204822232 | U | 12/2015 | | |
| CN | 108016644 | A | 5/2018 | | |
| DE | 1809656 | A1 * | 6/1970 | B65B 9/045 | |
| DE | 3020633 | A1 | 12/1981 | | |
| DE | 3118946 | A1 | 12/1982 | | |
| DE | 20006336 | U1 | 8/2000 | | |
| DE | 10343483 | A1 | 4/2005 | | |
| DE | 102014106400 | A1 | 11/2015 | | |
| DE | 202016000757 | U1 | 4/2016 | | |
| DE | 102014119351 | A1 | 6/2016 | | |
| DE | 102015105175 | A1 | 10/2016 | | |
| EP | 1816075 | A1 | 8/2007 | | |
| EP | 2412632 | A1 | 2/2012 | | |
| EP | 2740677 | A1 | 6/2014 | | |
| EP | 2778079 | A1 | 9/2014 | | |
| EP | 3028774 | A1 | 6/2016 | | |
| FR | 1387203 | A | 1/1965 | | |
| FR | 2003547 | A1 * | 11/1969 | B65B 9/045 | |
| WO | 2007137165 | A2 | 11/2007 | | |
| WO | 2014180823 | A1 | 11/2014 | | |

* cited by examiner

THERMO-FORMING PACKAGING MACHINE

CROSS-REFERENCE TO RELATED APPLICATIONS

This Application claims priority to European Patent Application No. 16196154.5, filed on Oct. 28, 2016, to Elmar Ehrmann, currently pending, the entire disclosure of which is incorporated herein by reference.

FIELD OF THE INVENTION

The invention relates to the field of packaging machines. In one embodiment, the invention relates to a thermo-forming packaging machine that may be configured for packaging foodstuff products.

BACKGROUND OF THE INVENTION

In known thermo-forming machines, troughs are formed in a lower film web using a forming station. The troughs are filled with products to be packaged in an inserting track. In a sealing station, the filled troughs are sealed with an upper film. In this process, the packages that are being formed can be evacuated or filled with protection gas in order to increase the durability of the packaged products. At a cutting station, the filled and sealed troughs provided in the lower film track are separated from one another in order to obtain individual packages or connected groups of packages. During the packaging process, the lower film web is conveyed using a transport device along a transport direction. The forming station, the inserting track, the sealing station and the cutting station are purposefully arranged along the transport direction in the mentioned order. The forming station, the sealing station and the cutting station can be disposed on a machine rack of the thermo-forming packaging machine. It is known to guide the products to be packaged via one or multiple feeding belts towards the thermo-forming packaging machine in the area of the inserting track where the products are put into the troughs of the lower film web, for example using a picket or manually. As the distance between the feeding belt and the troughs to be filled has to be overcome at each transfer of products from the feeding belt into the troughs, the clocking or cycle time depends among other things on this distance. The minimum distance that can be achieved between the feeding belt and the lower film web with the troughs that are formed in said lower film web is limited among other things by the space requirement of the machine rack and the side claddings on both sides of the thermo-forming packaging machine.

A thermo-forming packaging machine according to a specialized structural form is known from EP 2 778 079 A1. This machine comprises a side profile on whose inner side a chain guide for a film clamping chain for transporting the lower film web is installed. The side profile that is disposed along the inserting track is at that same time also a part of the product feeding device for conveying the products to be packaged towards the inserting track. According to this specialized structural form, the product feeding device is consequently formed in an integral way with the side profile of the thermo-forming packaging machine in order to reduce the distance between the fed products and the troughs to be filled and hence to shorten the ways for putting the products into the troughs. Integrating the product feeding device into the side profile of the thermo-forming packaging machine comes with the disadvantage that the thermo-forming packaging machine cannot simply be combined with different product feeding systems depending on the conditions of use. In addition, a packaging machine specialized this way can only be adapted with difficulty to spatial conditions of the place of use.

A different way of feeding products to be packaged to an inserting track of a thermo-forming packaging machine is known from DE 20 2016 000 757 U1. The thermo-forming packaging machine disclosed therein comprises clamping chains that are held in chain guides for the lower film to be held on both sides and transported along the transport direction. The chain guides are aligned horizontally along the forming station and along the sealing station. Along an inserting track that is located between the forming station and the sealing station, the chain guides have an ascending orientation. Along the inserting track, the chain guides are preferably inclined at an angle of 10° to 30° to the horizontal line. In the obliquely extending inserting track, products to be packaged are put directly into the troughs of the lower film via a product inserting belt that extends above the film transport plane in parallel to the transport direction and that is formed as a retraction belt. As the product inserting belt has to extend above the film transport plane for this purpose, attention has to be paid during construction of the thermo-forming packaging machine that movable upper parts of the forming station do not come into conflict with the product inserting belt during operation. The direct insertion of products into troughs that are guided along an ascending area using a retraction belt can be inappropriate for specific products and trough forms and requires accurate coordination of the operation of the individual components of the packaging machine.

Thermo-forming packaging machines that have complete cutting stations in order to separate multiple packages from a film composite are known from DE 30 20 633 A1 and DE 31 18 946 A1. The cut packages remain on support elements and are transported out of the complete cutting station onto a transport belt, which transports the packages out of the thermo-forming packaging machine and/or further, using drawing forward the remaining film grid. This comes with the disadvantage that the packages are fed uncontrollably to a subsequent working process on the transport belt. In addition and due to the transport belt that follows the complete cutting station, the overall length of the arrangement can become relatively large so that the arrangement cannot be used in narrow spaces.

Thus, there is a need in the art for a thermo-forming packaging machine that enables feeding of products to be packaged and/or removal of filled and sealed packages with a high work cycle and a high accuracy.

SUMMARY OF THE INVENTION

The purpose of the invention is to provide a thermo-forming packaging machine that enables feeding of products to be packaged and/or removal of filled and sealed packages with a high work cycle and a high accuracy.

The present invention is directed toward a thermo-forming packaging machine according to the invention that may comprise a forming station, an inserting track, a sealing station and a cutting station. A transport device of the thermo-forming packaging machine may be configured to convey a lower film in a film transport surface along a transport direction from the forming station via the inserting track to the sealing station and further to the cutting station. The forming station may comprise a forming tool for forming troughs in the lower film, in particular through thermo-forming of the lower film. In the inserting track that follows the forming station along the transport direction, the troughs formed in the lower film are filled with products to be packaged, in particular with foodstuffs. This can occur, for example, using a robot system such as a picker, or manually. The sealing station may comprise a sealing tool for sealing the troughs with an upper film. Sealing can occur in a protection gas atmosphere or under vacuum in order to make the packaged products last particularly long. For example the upper film can be sealed to the lower film in the sealing station using pressure and heat and/or through ultrasound welding for the purpose of sealing the troughs. The cutting station that may be arranged downstream of the sealing station along the transport direction may be configured for separation, in particular automated separation, of the sealed troughs so that the packaged products can be separated from the lower film composite. The cutting station can be formed for example as a complete cutting station.

An emphasis of the invention is placed in particular on how products to be packaged can be fed to the thermo-forming packaging machine and/or how finished packages can be lead away from the thermo-forming packaging machine. According to the principle on which the invention may be based, inserting and removing of elements (products to be packaged or readily packaged products) can be improved in a mostly analogous way during operation of the thermo-forming packaging machine.

In a thermo-forming packaging machine according to one embodiment of the invention, the film transport surface comprises between the forming station and the sealing station a first area that ascends along the transport direction. This first ascending area may be followed along the transport direction by a first even area that comprises the inserting track. The specifications "ascending" and "even" can be understood in the sense of the invention in comparison to a horizontal plane. Thus, an "ascending" area of the film transport surface is to be understood as an area in which a vertical height of the film transport surface increases when progressing along the transport direction. An "even" area represents an area throughout which the vertical height of the film transport surface remains at least essentially constant when progressing along the transport direction.

According to an embodiment of the invention with the first ascending area and the first even area of the film transport surface, a product feeding device that conveys in parallel to the transport direction for feeding products to be packaged extends in the transport direction at least along the inserting track and in a top view onto the thermo-forming packaging machine next to, or laterally adjacent to, the inserting track. Here, it may be sufficient that the product feeding device extends in parallel to the transport direction of the lower film in the area of the inserting track. It is not excluded that the product feeding device also conveys in a non-parallel direction to the transport direction. For example, the product feeding device can extend towards the inserting track at an angle to the transport direction. Products fed by the product feeding device can be put into the troughs of the lower film manually or automatically by the product feeding device along the inserting track, for example using a picker.

With the ascension of the film transport area to the first even area that may comprise the inserting track, it can be achieved that the film transport area may be at the inserting track elevated as compared to a side frame of a machine rack of the thermo-forming packaging machine that can for example carry the sealing station. Along the inserting track, the product feeding device can be moved particularly close to the lower film in which the troughs are formed as the side frame of the machine rack is not in the way. Therefore, a shorter processing way for the products between the product feeding device and the troughs of the lower film can be achieved and hence the work cycle time of the thermo-forming packaging machine can be decreased and the efficiency increased.

Alternatively, as another embodiment of the invention, or in addition to the first ascending area, the first even area and the corresponding product feeding device, the thermo-forming packaging machine can be formed in a way that the film transport surface comprises a second area, which ascends along the transport direction, between the sealing station and the cutting station. A second even area of the film transport surface follows the second ascending area at the cutting station. A packaging discharge device for leading away filled and sealed packages that conveys in parallel to the transport direction extends in the transport direction at least along the second even area and, in a top view onto the thermo-forming packaging machine, next to (laterally adjacent to) the second even area. After having been separated by the cutting station, the filled and sealed packages can be put onto the packaging discharge device in a sideway direction manually or automatically, for example using a picker, so as to be lead away from the thermo-forming packaging machine. By raising the film transport area through the second ascending area, the film transport surface can be elevated in the second even area at the cutting station as compared to a side frame of a machine rack of the thermo-forming packaging machine so that the machine rack, which can carry in particular the sealing station, does not hamper the packaging discharge device from being positioned particularly close to the film transport surface. Therefore, the transport path during placement of the packages onto the packaging discharge device may be reduced and the finished packages can be removed faster.

A packaging machine according to the invention can have both (a) a first ascending area, the first even area and the correspondingly arranged product feeding device, as well as (b) the second ascending area, the second even area and the correspondingly arranged packaging discharge device. However, it may be also conceivable that only the first ascending area, the first even area and the corresponding product feeding device are provided and that removal of the filled and sealed packages may be implemented at least partially in a different way. It would also be possible that only the second ascending area, the second even area and the corresponding packaging discharge device are provided and that feeding of the products to be packaged may be implemented at least partially in a different way.

Both with regard to the described measures for feeding the products as well as in relation to the described measures for discharging the packages, it may be achieved using an even area of the film transport surface, which may be elevated through an ascending area, that a respective transport device can sideways be moved as closely as possible to the film transport surface and that a respective transition path can be reduced this way.

The thermo-forming packaging machine can comprise a machine rack with a side frame with an upper interfering edge that may be disposed along the transport direction of the lower film. The machine rack can carry the forming station and/or the sealing station. Alternatively or in addition, the machine rack can also carry the cutting station. Through elevating the film transport surface in the first and/or second ascending area, the film transport surface can be led over the upper interfering edge of the side frame in the area that may be relevant for feeding the products and/or removal of the finished packages.

The transport device for the lower film can have a chain guide disposed along the transport direction in which at least one film transport chain for conveying the lower film may be guided. In particular, the chain guide can have guiding elements for guiding of film transport chains that are arranged on both sides along the transport direction. An exemplary chain guide may be known from EP 1 816 075 A1. Using an appropriate design of the chain guide, the desired course of the film transport surface, in particular the first and/or the second ascending area, can be implemented in a structurally easy way.

The chain guide may be preferably attached to the side frame. Particularly preferably, the chain guide may be located on the inside in relation to the side frame. Therefore, the chain guide may be integrated compactly in the thermoforming packaging machine and may be at least partially imperceptible towards the outside. In addition, unintended access that could lead to injuries may be prevented.

Ahead of the first and/or second ascending area of the film transport surface in relation to the transport direction, the film transport surface can be located under the interfering edge of the side frame. This can be implemented for example through an appropriate design of the chain guide. However, it would for example also be conceivable for the film transport surface to ahead of the first and/or second ascending area in relation to the film transport direction be located approximately-on the same level as the interfering edge of the side frame or slightly above the interfering edge of the side frame. To simplify processing by the forming station and/or sealing station, which may be preferably carried by the machine rack, it may be advantageous for the film transport surface to be located approximately on the same level as the interfering edge of the side frame of the machine rack in the areas of the forming station and/or the sealing station.

In its first and/or second even area, the film transport surface can be located at a higher place than the interfering edge of the side frame. In particular, in the first and/or the second even area the film transport surface can be located at least 5 cm, at least 10 cm or at least 15 cm above the interfering edge of the side frame. This way, it can be achieved that the side frame will not hamper a product feeding device and/or a packaging discharge device from being positioned close to the lower film.

The product feeding device can be designed as a product feeding belt. However, it may be also possible that the product feeding device is designed differently. For example, the product feeding device could be in the form of a shuttle arrangement for feeding of products. Exemplary shuttle arrangements are known from DE 10 2014 119 351 A1 and the DE 10 2014 106 400 A1. Such shuttle arrangements comprise a track system and transport shuttles, which are installed in said track system in a movable way along a conveying direction, with a surface for the insertion of products to be transported. The transport shuttles can be moved for example using changeable magnetic fields that can be created by the track system.

The packaging discharge device can be designed as a packaging discharge belt. However, it may be also possible that the packaging discharge device is formed differently, for example as a shuttle arrangement for leading away packages.

A conveyor surface of the product feeding device can be arranged at least in specific areas, in particular laterally next to the first even area of the film transport surface, above the side frame of the machine rack. Similarly, a conveying surface of the packaging discharge device can, in addition or alternatively, be arranged at least in specific areas, in particular laterally next to the second even area of the film transport surface, above the side frame of the machine rack. Therefore, the product feeding device and/or the packaging discharge device may be positioned very close to the lower film with respect to a sideway direction.

A distance of the first even area of the film transport surface to the product feeding device and/or a distance of the second even area of the film transport surface to the packaging discharge device can be less than 5 cm, less than 10 cm or less than 15 cm.

The first even area of the film transport surface can be located at least on the same level as the conveyor surface of the product feeding device. Similarly, the second even area of the film transport surface can, in addition or alternatively, be located at least on the same level as the conveyor surface of the packaging discharge device. It can be advantageous for the first even area of the film transport surface to be located approximately on the same level as the conveyor surface of the product feeding device and/or for the second even area of the film transport surface to be located approximately on the same level as the conveyor surface of the packaging discharge device. In this case, the path to be traveled during processing of products to be packaged may be also minimized in a vertical direction. For example a distance of the respective surfaces to one another along a vertical axis can amount to a maximum of 1 cm, a maximum of 2 cm or a maximum of 5 cm.

The product feeding device can essentially extend up to the sealing station. Therefore, a particularly long inserting track can be implemented, wherein a larger number of products can be put into the troughs, that have been formed in the lower film, along the inserting track so that the machine throughput can be increased.

The course of the film transport surface can be adapted according to a preferred arrangement of the forming station, the sealing station and the cutting station. For example, the film transport surface can comprise an area that follows the first even area and that descends along the transport direction. In particular, the vertical height of the film transport surface can descend throughout the descending area by the value by which it has been elevated throughout the first ascending area. This enables an arrangement of the forming station and the sealing station in a common horizontal plane without any major construction effort. Because of this, the forming station and the sealing station can be attached to the machine frame particularly easily. However, it would for example also be conceivable that no descending area of the film transport surface may be provided following the first even area. In this case, the sealing station could for example be arranged at a higher point than the forming station. For this purpose, the machine frame can be elevated in the area of the sealing station.

Other aspects and advantages of the present invention will be apparent from the following detailed description of the preferred embodiments and the accompanying drawing figures.

DESCRIPTION OF THE SEVERAL VIEWS OF THE DRAWING

In the following, an advantageous embodiment of the present invention will be explained in more detail making reference to a drawing, in which the individual figures show.

DETAILED DESCRIPTION OF THE INVENTION

Figure 1:
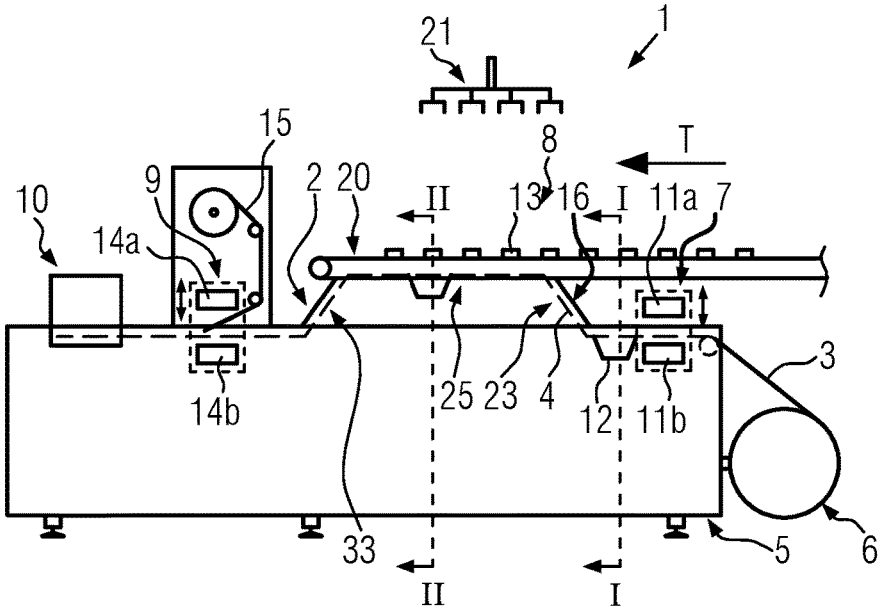
FIG. 1 is a schematic side view of one embodiment of a thermoform packaging machine in accordance with the teachings of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 2:
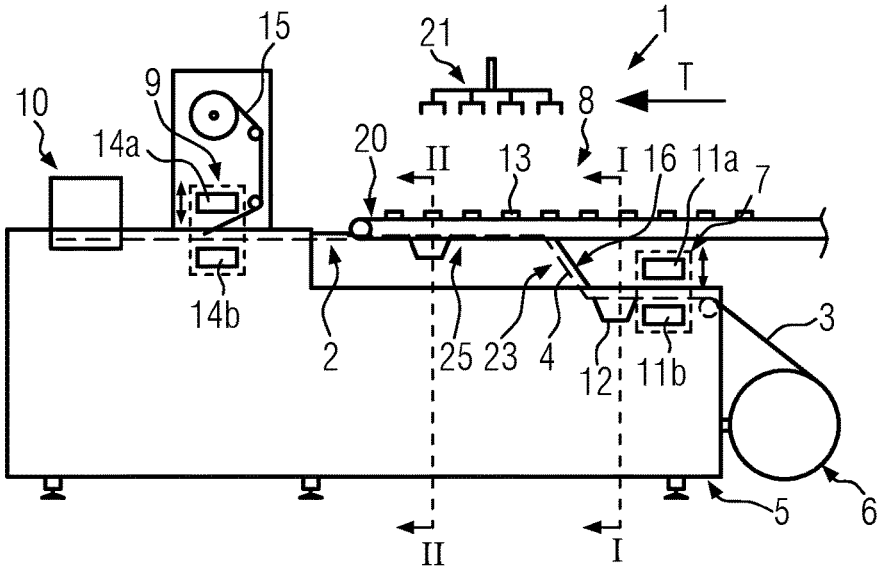
FIG. 2 is a schematic side view of another embodiment a thermoform packaging machine in accordance with the teachings of the present invention.

FIG. 1 shows a schematic side view of a thermo-forming packaging machine 1 according to an embodiment of the invention. FIG. 2 shows a schematic side view of a thermo-forming packaging machine 1 according to a further embodiment that corresponds in some aspects to the embodiment shown in FIG. 1.

In both cases, the thermo-forming packaging machine 1 comprises a transport device 2 that is configured to convey a lower film 3 in a film transport surface 4 (areas of said surface that are not visible in the side view are displayed with dashed lines) along a transport direction T. The lower film 3 can for example be taken from a stock roll 6 that is installed on a machine rack 5 of the thermo-forming packaging machine 1. Along the transport direction T, a forming station 7, an inserting track 8, a sealing station 9 and a cutting station 10 are provided in the mentioned order. During operation of the thermo-forming packaging machine 1, troughs 12 are formed in the lower film 3 by the forming station 7 using a forming tool, in particular using thermo-forming. For this purpose, the forming tool can comprise a forming tool upper part 11*a* and a forming tool lower part 11*b*. Along the inserting track 8, the troughs 12 are filled with products 13 to be packaged. The sealing station 9 comprises a sealing tool for sealing the troughs 12 with an upper film 15. The sealing tool can comprise a sealing tool upper part 14*a* and a sealing tool lower part 14*b*. The sealing tool and/or a part of it can be movable in a direction perpendicular to the transport direction T and configured to seal the lower film 3 and the upper film 15 along appropriate welding seams 16 (cf. FIGS. 5A and 5B) using pressure and heat. The sealing station 9 can be configured to perform the sealing process under a protective gas atmosphere or under vacuum in order to increase the durability of the packaged products 13. The cutting station 10 that is arranged downstream of the sealing station 9 in the transport direction T is configured to separate the packages formed by the troughs 12, which have been filled and sealed with the upper film 15, from one another. In particular, the cutting station 10 can be a complete cutting station.

To bring the products 13 to be packaged to the inserting track 8, a product feeding device 20, which is formed as a product feeding belt in the shown embodiment, is provided. This product feeding device conveys the products 13 at least over certain parts in parallel to the transport direction T of the lower film. The product feeding device 20 extends at least along the inserting track 8. From a top view onto the thermo-forming packaging machine 1 (not shown), the product feeding device 20 may extend next to (laterally adjacent to) the inserting track 8, i.e. next to the lower film 3 in the area of the inserting track 8. A product feeding device 20 can be provided respectively on both sides to be able to feed products 13 to be packaged to both sides of the lower film 3. But providing a product feeding device 20 on one side of the inserting track 8 is sufficient. The products 13 to be packaged can laterally be put from the product feeding device 20 into the troughs 12 of the lower film 3 using a picker 21. It is also conceivable to put the products from the product feeding device 20 into the troughs 12 in a different automated or manual way.

In the displayed embodiments, the transport device 2 for conveying the lower film 3 comprises chain guides 16 that are arranged on both sides along the transport direction T and in which respectively one or multiple film transport chains 17 are guided for conveying the lower film 3. The course of the film transport surface 4 can be determined through appropriate installation of the chain guides 16. The chain guides 16 disposed on both sides are preferably arranged in parallel to one another so that the film transport surface 4 has essentially no inclination in relation to a transversal direction of the thermo-forming packaging machine 1.

In the embodiments of FIGS. 1 and 2, the lower film 3 is guided in such a way that the film transport surface 4 comprises a first ascending area 23 along the transport direction T between the forming station 7 and the sealing station 9. In the course of the first ascending area 23, the vertical height of the film transport surface 4 increases along the transport direction T of the lower film 3. The vertical height of the film transport surface 4 can increase strictly monotonously or monotonously in the ascending area 23. But it is also conceivable that the vertical height of the film transport surface 4 decreases in the meantime in the course of the ascending area 23 as long as the vertical height of the film transport surface 4 in relation to the transport direction T is lower at the beginning of the ascending area 23 than at the end of the ascending area 23. For example, the vertical height of the film transport surface 4 can increase throughout the first ascending area 23 by at least 5 cm, at least 10 cm or at least 15 cm. A first even area 25, in which the film transport surface 4 extends at least essentially horizontally, follows the first ascending area 23. The first even area 25 comprises the inserting track 8 for filling the troughs 12 with the products 13 to be packaged.

Figure 3A:
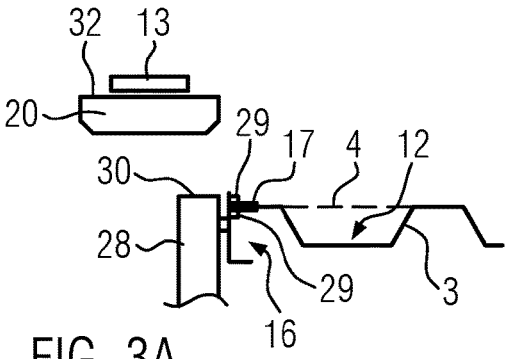
FIG. 3A is a schematic sectional view of a portion of the thermoform packaging machine of FIG. 1 and FIG. 2 cut along the line I-I.

FIG. 3A shows a sectional section view through the thermo-forming packaging machines 1 displayed in FIGS. 1 and 2, wherein the situation of the section plane is respectively marked by the line I-I in FIGS. 1 and 2 and wherein the section plane is perpendicular to the transport direction T. In the displayed embodiment, the chain guide 16, in which the film transport chain 17 for conveying the lower film 3 is guided, is installed on an inner side of a side frame 28 of the machine rack 5 of the thermo-forming packaging machine 1. In the shown embodiment, the chain guide 16 comprises an element that is L-shaped in the section and on which guiding rails 29 are provided between which the film transport chain 17 is guided.

FIG. 3A illustrates the situation at a position ahead of the first ascending area 23 of the film transport surface 4 in relation to the transport direction T. In the displayed embodiments, the film transport surface 4 is here arranged below an interfering edge 30 of the side frame 28. However, this is not necessarily required. The film transport surface 4 could also be located on the same level as the interfering edge 30 of the side frame 28 or be arranged slightly above it. It is advantageous for the film transport surface 4 to be arranged slightly below the interfering edge 30 or approximately on the same level as the interfering edge 30 because this way the lower film 3 can be processed optimally by the forming station 7 that is carried by the machine rack 5 without the operation of the forming station 7 being affected by the machine rack 5.

In the displayed embodiment, the product feeding device 20 is arranged above the side frame 28 of the machine rack 5 even ahead of the first ascending area 23. However, this is not required. It would also be conceivable for the product feeding device 20 to be diagonally guided towards the thermo-forming packaging machine 1 from a laterally farther distance and to extend in parallel to the transport direction T only in the area of the inserting track 8. This could for example ensure that the product feeding device 20 will not hamper the operation of the forming station 7.

Figure 3B:
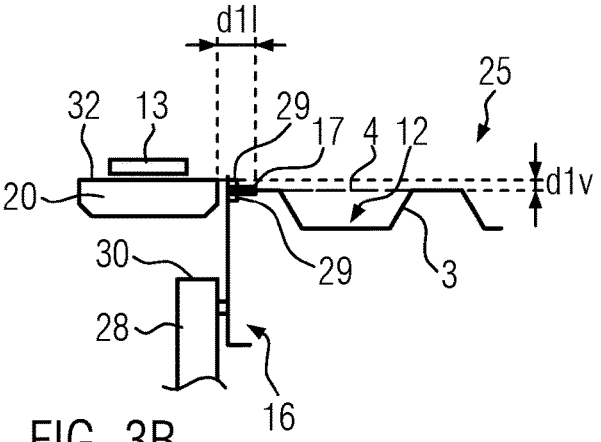
FIG. 3B is a schematic sectional view of a portion of the thermoform packaging machine of FIG. 1 and FIG. 2 cut along the line II-II.

FIG. 3B shows a sectional section view through the thermo-forming packaging machines 1 displayed in FIG. 1 und 2, wherein the situation of the section plane that is perpendicular to the transport direction T is indicated by the line II-II in FIGS. 1 and 2. FIG. 3B shows a section in the area of the first even area 25 of the film transport surface 4.

Compared to the illustration from FIG. 3A (area ahead of the first ascending area 23 of the film transport surface), the film transport surface 4 is provided at a higher position in FIG. 3B (first even area 25 of the film transport surface 4). In particular, the film transport surface 4 is at a higher level that the interfering edge 30 of the side frame 28 in the first even area 25. It becomes clear in FIG. 3B that this allows positioning the product feeding device 20 particularly close to the inserting track 8, in particular to the lower film 3 in the area of the inserting track 8. Due to the elevated film transport surface 4, the product feeding device 20 can extend over the interfering edge 30 of the side frame 28 of the machine rack 5 while a conveying surface 32 of the product feeding device 20 can be located essentially on the same level as the film transport surface 4. Therefore, the path to be traveled transversally to the transport direction T during placement of the products 13 from the conveying surface 32 of the product feeding device 20 into the troughs 12 can be minimized and hence the working cycle of the thermo-forming packaging machine 1 can be increased. It is for example conceivable that a lateral distance d1*l* between the conveying surface 32 of the product feeding device 20 and the first even area 25 of the film transport surface 4 is less than 5 cm, less than 10 cm or less than 15 cm. A vertical distance d1*v* between the conveying surface 32 of the product feeding device 20 and the first even area 25 of the film transport surface 4 can for example be less than 1 cm, less than 2 cm, less than 5 cm or less than 10 cm.

As becomes evident from FIGS. 1 and 2, the product feeding device 20 can extend essentially up to the sealing station 9. This can mean that a distance measured along the transport direction T between the sealing station 9 and the product feeding device 20 can be less than 50 cm, less than 30 cm, less than 20 cm or less than 10 cm. Due to such a design, the inserting track 8 can be made particularly long.

According to the embodiment shown in FIG. 1, the film transport surface 4 comprises an area 33 that follows the first even area 25 in relation to the transport direction T and that descends along the transport direction T. In the shown case, the level of the film transport surface 4 is reduced throughout the descending area 33 by the same value by which it has increased in the course of the first ascending area 33. Therefore, it can be achieved that in the area of the sealing station 9 that is disposed downstream of the descending area 33, the film transport surface 4 is arranged approximately at the same level as in the area of the forming station 7. Similar to the forming station 7, the sealing station 9 can simply be installed on the machine rack 5 and finds the lower film 3 on a level that is suitable for processing.

According to the embodiment shown in FIG. 2, no descending area of the film transport surface 4 is provided following the first even area 25. Rather, following the insertion area 8 in relation to the transport direction T the side frame 28 of the machine rack 5 is formed higher than in the first even area 25 and further ahead in relation to the transport direction T. The sealing station 9 installed on the machine rack 5 is consequently arranged in an elevated position in relation to the forming station 7. Therefore, the lower film 3 can be fed to the sealing station 9 installed on the machine rack 5 on an appropriate level without providing a descending area of the film transport surface 4. It would also be conceivable to arrange the sealing station 9 on any other level if the film transport surface 4 was adapted appropriately.

After the sealing station 9, the lower film 3 with the troughs 12 that were formed in said film, filled and sealed with the upper film 15 is fed to the cutting station 10 where the filled and sealed troughs 12 are separated. Subsequently, the separated, packaged products 13 can be removed from the thermo-forming packaging machine 1. This can occur in different ways that are not illustrated in detail in the FIGS. 1 and 2. For example the removal of the separated packages could occur in a simple way through manual removal after separation by the cutting station 10. It is also conceivable to transport the packages further via discharge devices, in particular discharge belts. For this purpose, the packages can manually or automatically be put or dropped onto one or multiple discharge devices.

Figure 4:
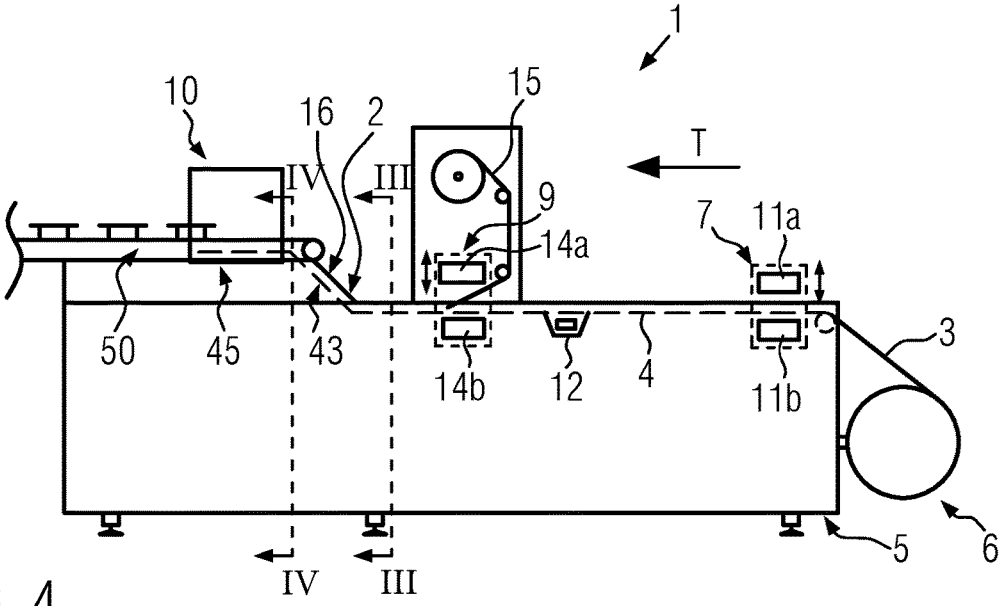
FIG. 4 is a schematic side view of an embodiment of a thermo-forming packaging machine in accordance with the teachings of the present invention having a second ascending area and a second even area of the film transport surface.

FIG. 4 shows a schematic side view of a thermo-forming packaging machine 1 according to an embodiment that enables leading away the separated finished packages particularly fast. In this embodiment, too, the thermo-forming packaging machine 1 comprises a transport device 2 that is configured to convey the lower film 3 in a film transport surface 4 along the transport direction T. Also here, the lower film 3 passes the forming station 7, the inserting track 8, the sealing station 9 and the cutting station 10 in the mentioned order along the transport direction T. The forming station 7, the sealing station 9 and the cutting station 10 can be formed as in the embodiments of FIG. 1 to 3. In the illustration shown in FIG. 4, the film transport surface 4 extends from the forming station 7 via the inserting track 8 up to the sealing station 9 in a horizontal plane. But this is not necessary. Details regarding the feeding of the products 13 to the inserting track 8 or the placement of the products 13 into the troughs 12 in the lower film formed by the forming station 7 are not explained any further. The products 13 could for example be inserted into the troughs 12 manually or automatically, in particular using a picker 21.

Similarly to the embodiments of FIGS. 1 to 3, the transport device 2 for conveying the lower film 3 can comprise chain guides 16 that are arranged on both sides along the transport direction T and in which respectively one or multiple film transport chains 17 are guided for conveying the lower film 3. According to the embodiment from FIG. 4, the film transport surface 4 has a special course behind the sealing station 9 with respect the transport direction T that enables leading away readily packaged products 13 fast and efficiently. The lower film 3 is guided in a way that the film transport surface 4 comprises a second ascending area 43 along the transport direction T between the sealing station 9 and the cutting station 10. In the course of the second ascending area 43, the vertical height of the film transport surface 4 increases along the transport direction T of the lower film 3. For example, the vertical height of the film transport surface 4 can ascend throughout the second ascending area 43 by at least 5 cm, at least 10 cm or at least 15 cm. A second even area 45, in which the film transport surface 4 extends at least in an essentially horizontal way, follows the second ascending area 43 at the cutting station 10.

To lead away the packaged products 13 from the thermo-forming packaging machine 1 after separation by the cutting station 10, a packaging discharge device 50, which is designed as a packaging discharge belt in the shown embodiment, is provided. This packaging discharge device 50 extends at least along the second even area 45. From a top view onto the thermo-forming packaging machine (not shown), the packaging discharge device 50 extends next to (laterally adjacent to) the second even area 45 of the lower film 3. A packaging discharge device 50 can be provided respectively on both sides in order to lead away finished packages to both sides of the lower film 3. But it is sufficient if a packaging discharge device 50 is provided on one side of the film transport surface 4. The packaged products 13 can be put laterally onto the packaging discharge device 50 using a picker 21. It is also conceivable to put the packaged products 13 onto the packaging discharge device 50 in a different automated or manual way.

Alternatively, it would also be possible for the packaging discharge device 50 to extend not next to but below the cutting station 10, for example on approximately the same level as the film transport surface 4 ahead of the ascending area 43 so that the packages separated at the cutting station 10 fall down onto the packaging discharge device 50.

Figure 5A:
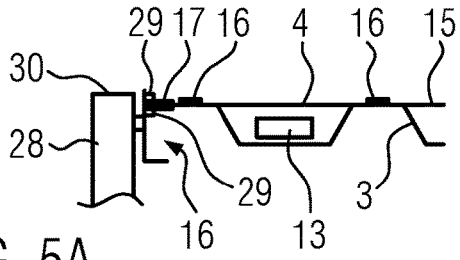
FIG. 5A is a schematic sectional view of a portion of the thermoform packaging machine of FIG. 4 cut along the line III-III.

FIG. 5A shows a sectional section view through the thermo-forming packaging machine 1 displayed in FIG. 4, wherein the situation of the section plane is marked in FIG. 4 by the line III-III and the section plane is perpendicular to the transport direction T. As in the embodiments of FIG. 1 to 3, the chain guide 16, in which the film transport chain 17 for conveying the lower film 3 is guided, is installed on an inner side of a side frame 28 of the machine rack 5 of the thermo-forming packaging machine 1. The chain guide 16 comprises an element that is L-shaped in section and on which guiding rails 29 are provided between which the film transport chain 17 is guided.

FIG. 5A displays the situation at a position that is located ahead of the second ascending area 43 of the film transport surface 4 in relation to the transport direction T. In the shown embodiment, the film transport surface 4 is arranged below an interfering edge 30 of the side frame 28 in this case. However, this is not necessarily required. The film transport surface 4 could also be located at the same level as the interfering edge 30 of the side frame 28 or be disposed slightly above. It is advantageous for the film transport surface 4 to be arranged slightly below the interfering edge 30 or at approximately the same level as the interfering edge 30 as this allows for optimal closing of the troughs 12 formed in the lower film 3 by the sealing station 9 carried by the machine rack 5 without there being any impairment of the operation of the sealing station 9 by the machine rack 5.

Figure 5B:
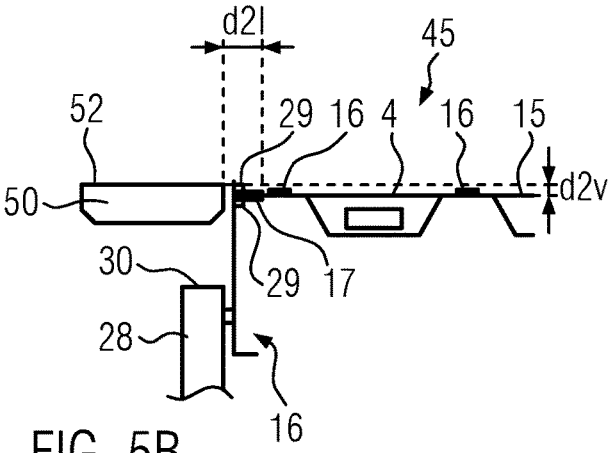
FIG. 5B is a schematic sectional view of a portion of the thermoform packaging machine of FIG. 4 cut along the line IV-IV.

FIG. 5B shows a sectional section view through the thermo-forming packaging machine 1 displayed in FIG. 4, wherein the situation of the section plane that is perpendicular to the transport direction T is indicated by the line IV-IV in FIG. 4. FIG. 5B shows a section in the area of the second even area 45 of the film transport surface 4.

Compared to the illustration from FIG. 5A (area ahead of the second ascending area 43 of the film transport surface 4), the film transport surface 4 is provided at a higher position in FIG. 5B (second even area 45 of the film transport surface 4). In particular, the film transport surface 4 is at a higher level than the interfering edge 30 of the side frame 28 in the second even area 45. It becomes evident in FIG. 5B that this allows for positioning the packaging discharge device 50 particularly close to the second even area 45 of the lower film 3. Due to the elevated film transport surface 4, the packaging discharge device 50 can extend above the interfering edge 30 of the side frame 28 of the machine rack 5 while a conveying surface 52 of the packaging discharge device 50 can essentially be at the same level as the film transport surface 4 at the same time. Due to this, the path to be traveled during placement of the packages onto the conveying surface 52 of the packaging discharge device 50 can be minimized and hence the work cycle of the thermo-forming packaging machine 1 can be increased. It is for example conceivable that a lateral distance d2*l* between the conveying surface 52 of the packaging discharge device 50 and the second even area 45 of the film transport surface 4 is less than 5 cm, less than 10 cm or less than 15 cm. A vertical distance d2*v* between the conveying surface 52 of the packaging discharge device 50 and the second even area 45 of the film transport surface 4 can for example be less than 1 cm, less than 2 cm, less than 5 cm or less than 10 cm.

With reference to the FIG. 1 to 3, thermo-forming packaging machines 1, which allow for a particularly fast insertion of products 13 to be packaged into the troughs 12 formed in the lower film 3 in the area of the inserting track 8, were described. As described, the film transport surface 4 comprises for this purpose the first ascending area 23 and the first even area 25 that comprises the insertion track 8. In addition, the product feeding device 20 for feeding products 13 extends in the transport direction T at least along the inserting track 8 and in a top view next to (or laterally adjacent to) the inserting track 8. Following the sealing station 9, the course of the film transport surface 4 can in principle be formed in any way. After separation of the packages by the cutting station 10, the readily packaged products 13 can be extracted in any way from the thermoforming packaging machine 1. For example, the packaged products 13 could be extracted manually or automatically.

With reference to the FIGS. 4, 5A and 5B, a thermo-forming packaging machine 1, which enables particularly efficient extraction of the packaged and separated products 13 from the thermo-forming packaging machine 1, was described. For this purpose, the second ascending area 43 and the second even area 45 of the film transport surface 4 are provided following the sealing station 9. In addition, the packaging discharge device 50 for leading away filled and sealed packages extends in relation to the transport direction T at least along the second even area 45 and in a top view next to (laterally adjacent to) the second even area 45 of the film transport surface 4. In relation to the transport direction T ahead of the sealing station 9, the course of the film transport surface 4 can in principle be chosen in any way. Also the way of feeding products 13 to be packaged as well as putting the products 13 to be packaged into the troughs 12 of the lower film 3 can be designed in any way. The products 13 can for example be put into the troughs 12 manually or automatically.

Hence, it is conceivable that, according to the invention, either only the first ascending area 23, the first even area 25 as well as the product feeding device 20 are provided and that the extraction of the finished packages occurs in any way. Likewise, it is possible that only the second ascending area 43, the second even area 45 and the packaging discharge device 50 are provided and that feeding of the products 13 to the inserting path 8 and placement of the products 13 into the troughs 12 formed in the lower film 3 occur in an arbitrary manner.

According to a particularly advantageous embodiment of a thermo-forming packaging machine 1, however, the specifically designed product feeder (FIG. 1 to 3) with the first ascending area 23, the first even area 25 and the product feeding device 20 and at the same time the described packaging discharge system with the second ascending area 43, the second even area 45 and the packaging discharge device 50 are provided in a combined way. Due to this, the work cycle of the thermo-forming packaging machine 1 can be increased particularly strongly as both the product influx as well as the leading away of the finished packages take place particularly fast and efficiently. According to such an embodiment, the course of the film transport surface 4 in the area between the forming station 7 and the sealing station 9 could correspond for example to the course shown in FIG. 1 or 2. Following the sealing station 9, the course of the film transport surface 4 could for example be as displayed in FIG. 4.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A thermo-forming packaging machine comprising:

a forming station with a forming tool for forming troughs in a lower film;

an inserting track for filling the troughs with products;

a sealing station with a sealing tool for sealing the troughs with an upper film;

a cutting station for separating the sealed troughs;

a transport device that is configured to convey the lower film in a film transport surface along a transport direction from the forming station via the inserting track to the sealing station and further to the cutting station;

a product feeding device for feeding products, wherein the product feeding device conveys in parallel to the transport direction and extends in the transport direction at least along the inserting track and laterally adjacent to the inserting track; and a machine rack having a side frame, wherein the side frame is arranged along the transport direction and has an upper interfering edge;

wherein the film transport surface between the forming station and the sealing station comprises a first ascending area and a first even area following the first ascending area, wherein the first ascending area ascends along the transport direction, and wherein the first even area includes the inserting track; and wherein the film transport surface is guided to a level above the interfering edge of the side frame through the first ascending area.

2. The thermo-forming packaging machine according to claim 1, wherein the transport device has a chain guide that is arranged along the transport direction and guides at least one film transport chain for conveying the lower film.

3. The thermo-forming packaging machine according to claim 2, wherein the chain guide is fastened on the side frame.

4. The thermo-forming packaging machine according to claim 1, wherein in the first even area the film transport surface is disposed above the interfering edge of the side frame.

5. The thermo-forming packaging machine according to claim 1, wherein the film transport surface is located below the interfering edge of the side frame upstream of the first ascending area in the transport direction.

6. The thermo-forming packaging machine according to claim 1, wherein a conveyor surface of the product feeding device is arranged at least in certain areas above the side frame of the machine rack or above an upper side of the forming station.

7. The thermo-forming packaging machine according to claim 1, wherein a lateral distance of the first even area of the film transport surface to the product feeding device is one of less than 5 cm, less than 10 cm, or less than 15 cm.

8. The thermo-forming packaging machine according to claim 1, wherein the first even area of the film transport surface is on substantially the same horizontal level as a conveying surface of the product feeding device.

9. The thermo-forming packaging machine according to claim 1, wherein the product feeding device extends substantially up to the sealing station.

10. The thermo-forming packaging machine according to claim 1, wherein the film transport surface comprises an area that is downstream of the first even area in the transport direction and that descends along the transport direction.

11. The thermo-forming packaging machine according to claim 10, wherein the forming station and the sealing station are arranged in a common horizontal plane.

12. The thermo-forming packaging machine according to claim 1, wherein the film transport surface comprises between the sealing station and the cutting station a second ascending area ascending along the transport direction and being followed at the cutting station by a second even area, and wherein the thermo-forming packaging machine further comprises a packaging discharge device for leading away filled and sealed packages, which conveys in parallel to the transport direction and extends in the transport direction at least along the second even area and laterally adjacent to the second even area.

13. A thermo-forming packaging machine comprising:

a forming station with a forming tool for forming troughs in a lower film;

an inserting track for filling the troughs with products;

a sealing station with a sealing tool for sealing the troughs with an upper film;

a cutting station for separating the sealed troughs;

a transport device that is configured to convey the lower film in a film transport surface along a transport direction from the forming station via the inserting track to the sealing station and further to the cutting station; and a machine rack having a side frame, wherein the side frame is arranged along the transport direction and has an upper interfering edge;

wherein the film transport surface comprises a first ascending area ascending along the transport direction and being followed by a first even area;

wherein the film transport surface is guided to a level above the interfering edge of the side frame through the first ascending area; and wherein the forming station and the sealing station are arranged in a common horizontal plane.

14. A thermo-forming packaging machine comprising:

a forming station with a forming tool for forming troughs in a lower film;

an inserting track for filling the troughs with products;

a sealing station with a sealing tool for sealing the troughs with an upper film;

a cutting station for separating the sealed troughs;

a transport device that is configured to convey the lower film in a film transport surface along a transport direction from the forming station via the inserting track to the sealing station and further to the cutting station;

a packaging discharge device for leading away filled and sealed packages, wherein the packaging discharge device conveys in parallel to the transport direction; and a machine rack having a side frame, wherein the side frame is arranged along the transport direction and has an upper interfering edge;

wherein the film transport surface between the sealing station and the cutting station comprises an ascending area being followed at the cutting station by an even area, wherein the ascending area ascends along the transport direction;

wherein the packaging discharge device extends in the transport direction at least along the even area and laterally adjacent to the even area; and wherein the film transport surface is guided to a level above the interfering edge of the side frame through the ascending area.

15. The thermo-forming packaging machine according to claim 14, wherein a lateral distance of the even area of the film transport surface to the packaging discharge device is one of less than 5 cm, less than 10 cm, or less than 15 cm.

16. The thermo-forming packaging machine according to claim 14, wherein the even area of the film transport surface is at least on the same level as a conveying surface of the packaging discharge device.

17. The thermo-forming packaging machine according to claim 14, wherein in the even area the film transport surface is disposed above the interfering edge of the side frame.

18. The thermo-forming packaging machine according to claim 14, wherein the film transport surface is located below the interfering edge of the side frame upstream of the ascending area in the transport direction.

19. The thermo-forming packaging machine according to claim 14, wherein a conveyor surface of the packaging discharge device is arranged at least in certain areas above the side frame of the machine rack or above an upper side of the forming station.

* * * * *